US005096446A

United States Patent [19]

Tazaki et al.

[11] Patent Number: 5,096,446

[45] Date of Patent: Mar. 17, 1992

[54] EXHAUST SILENCER UNIT FOR PROPULSION UNIT

[75] Inventors: Hiroshi Tazaki; Kazumasa Ito; Atsushi Sugawara, all of Hamamatsu, Japan

[73] Assignee: Sanshin Kogyo Kanushiki Kaisha, Hamamatsu, Japan

[21] Appl. No.: 569,998

[22] Filed: Aug. 20, 1990

[30] Foreign Application Priority Data

Aug. 21, 1989 [JP] Japan ..... 1-214338

[51] Int. Cl.[5] ..... B63H 21/38

[52] U.S. Cl. ..... 440/38; 440/89; 114/270

[58] Field of Search ..... 440/88, 89, 38, 54; 60/310, 313; 181/220, 227, 228, 235, 231, 260, 238, 264, 265, 266, 269, 275, 204; 114/270

[56] References Cited

U.S. PATENT DOCUMENTS

| | | | |
|---|---|---|---|
| 2,682,854 | 7/1954 | Cohen | 440/54 |
| 3,296,997 | 1/1967 | Hoiby et al. | 440/89 |
| 4,019,456 | 4/1977 | Harbert | 440/89 |
| 4,303,401 | 12/1981 | Sanmi et al. | 440/89 |
| 4,421,490 | 12/1983 | Nakahama | 440/88 |
| 4,795,383 | 1/1989 | Binversie et al. | 440/89 |
| 4,906,214 | 3/1990 | Towner | 440/89 |
| 4,965,997 | 10/1990 | Suzuki et al. | 440/89 |

*Primary Examiner*—Jesus D. Sotelo
*Assistant Examiner*—Stephen P. Avila
*Attorney, Agent, or Firm*—Ernest A. Beutler

[57] ABSTRACT

A number of embodiments of exhaust silencers for marine propulsion units including an exhaust device having a first expansion chamber, a pair of second expansion chambers and a third expansion chamber all formed within a common housing. The flow of exhaust gases is from the exhaust of the engine into the first expansion chamber, directly from the first expansion chamber into each of the pair of second expansion chambers and directly from the second expansion chambers to the third expansion chamber. In all embodiments the flow from the second expansion chambers to the third expansion chamber is in confronting relationships so as to improve silencing. In one embodiment, the second expansion chambers have different effective volumes so as to provide an extended range of tuning for the silencing.

23 Claims, 4 Drawing Sheets

EXHAUST SILENCER UNIT FOR PROPULSION UNIT

BACKGROUND OF THE INVENTION

This invention relates to an exhaust silencer unit for a marine propulsion unit and more particularly to an improved expansion chamber type of silencing device for the exhaust gases of a marine propulsion unit.

It is well known that the exhaust gases of internal combustion engines can, if emitted to the atmosphere unmuffled, create substantial noise. It has, therefore, been the practice to provide some form of silencing device in the exhaust system for such engines. The problems of silencing the exhaust gases of an internal combustion engine are magnified when the engine runs over a wide range of speeds and load conditions since the tuning of the exhaust system for these varying conditions can give rise to substantial problems. In addition, when the exhaust system is used in a marine vehicle, still further problems are encountered because of the relatively small space and confined area in which the exhaust system maybe provided.

It is, therefore, a principal object of this invention to provide an improved exhaust silencer for the exhaust gases of an internal combustion engine.

It is a further object of this invention to provide a high efficiency, relatively small size exhaust silencer for a marine propulsion unit.

It is a still further object of this invention to provide an improved exhaust silencer unit for a marine propulsion unit that has a compact configuration and yet which provides good silencing under a wide range of engine running conditions.

The use of expansion chambers in exhaust systems is well known to achieve good silencing. The expansion chamber is effective to produce the good silencing under a wide range of load conditions and the number of expansion chambers employed in the exhaust system can significantly improve the silencing. However, in connection with marine propulsion units it has been difficult to provide plural expansion chambers due to the relatively small size in compact nature required for the exhaust system.

In addition, it is well known in marine propulsion units to mix the coolant from the engine cooling system with the exhaust gases and discharge them together. This provides a simplicity in the plumbing arrangement for the engine and also the addition of the cooling water to the exhaust gases can improve silencing. However, it must be ensured that the coolant from the engine cooling jacket and also the water from the body of water in which the watercraft is operating does not re-enter the engine through the exhaust system which could cause damage to the engine.

It is, therefore, a further object of this invention to provide an exhaust system for a marine propulsion unit embodying multiple expansion chambers and which ensures that water cannot re-enter the engine through exhaust ports.

SUMMARY OF THE INVENTION

This invention is adapted to be embodied in an exhaust silencer for the exhaust gases of an internal combustion engine and comprises a first expansion chamber and an exhaust inlet for delivering exhaust gases from the engine to the first expansion chamber. A pair of spaced apart second expansion chambers each communicate directly with the first expansion chamber. A third expansion chamber is provided and each of the second expansion chambers communicate directly with this third expansion chamber. Exhaust gases are discharged to the atmosphere from the third expansion chamber.

DETAILED DESCRIPTION OF THE PREFERRED EMBODIMENTS

Figure 1:
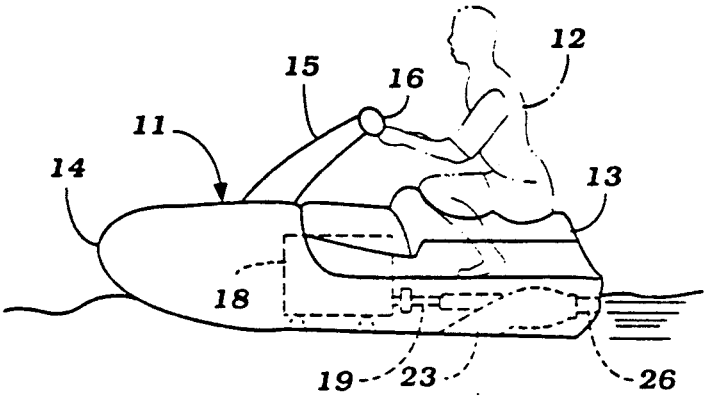
FIG. 1 is a side elevational view of a small watercraft having an exhaust system constructed in accordance with an embodiment of the invention.
Figure 2:
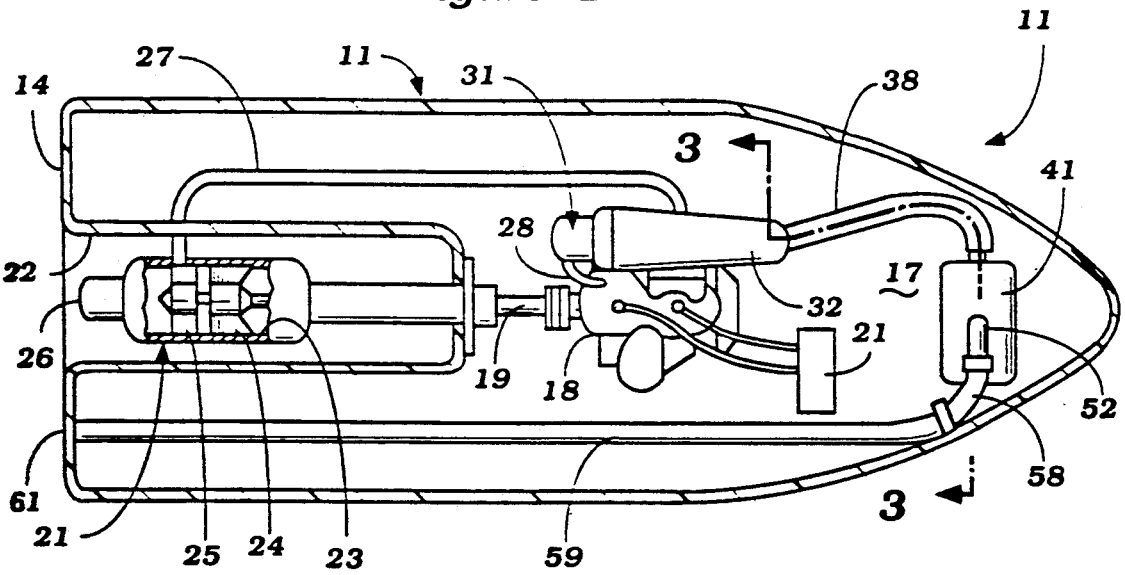
FIG. 2 is an enlarged top elevational view of the watercraft, with a portion of the hull removed so as to more clearly show the internal construction.

Referring first to FIGS. 1 and 2, a small watercraft constructed in accordance with an embodiment of the invention is identified generally by the reference numeral 11. The watercraft 11 is of the type that is designed to be operated by a single rider, shown in phantom and identified by the reference numeral 12, seated in straddle fashion on a seat 13. The seat 13 is carried at the rear portion of a hull 14 behind a mast 15 on which a tiller 16 is provided for control of the watercraft.

The hull 14 has a forwardly position engine compartment 17 in which an internal combustion engine, indicated generally by the reference numeral 18, is positioned. The engine 18 may be of any known type and, in the illustrated embodiment, is of the two-cylinder, two-cycle crankcase compression type. It is to be understood, however, that the invention, which relates to the exhaust system to be hereinafter described, can be utilized with a wide variety of engine types.

The engine 18 drives an output shaft which is coupled to the input shaft 19 of a jet propulsion unit, indicated generally by the reference numeral 21. The jet propulsion unit 21 is positioned within a tunnel 22 formed to the rear of the engine compartment 17 and underlying the operator's seat 13. The jet propulsion unit includes a downwardly facing water inlet 23 through which water is drawn by an impeller 24 that is drivingly coupled to the input shaft 19. This water is then discharged passed straigthening vanes 25 to a steering nozzle 26 for propulsion and steering of the watercraft 11 in a well known manner.

The engine 18 is provided with a cooling system that draws water from the body of water in which the watercraft 11 is operating and then discharges it back to this body of water through the exhaust system to be described. This cooling system includes a coolant inlet conduit 27 that draws water from the jet propulsion unit 21 and which water may be partially pressurized by the impeller 24. The water then flows through the internal cooling jacket of the engine and is discharged therefrom through a discharge conduit 28.

Figure 3:
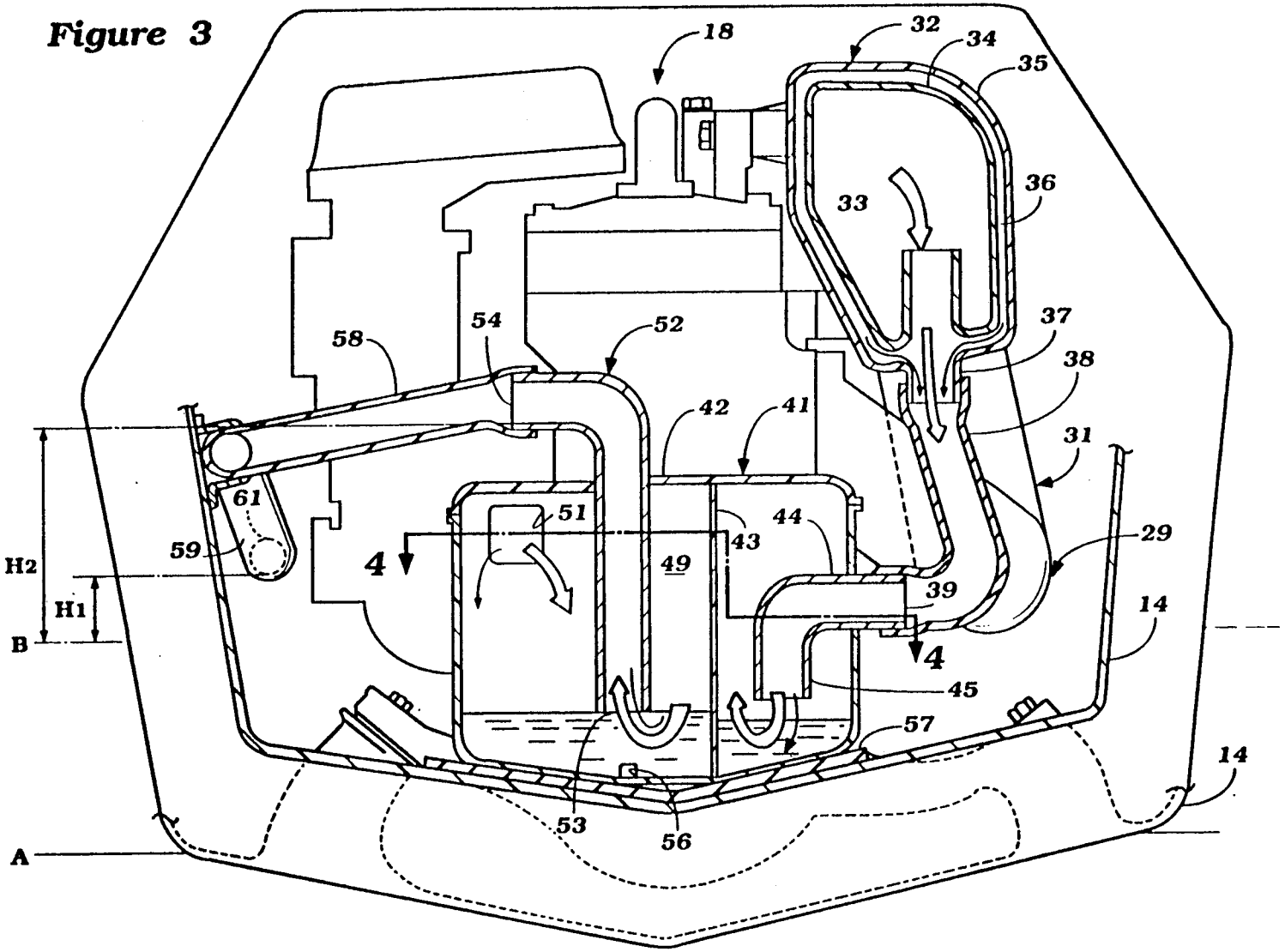
FIG. 3 is an enlarged cross-sectional view taken along the line 3—3 of FIG. 2.
Figure 4:
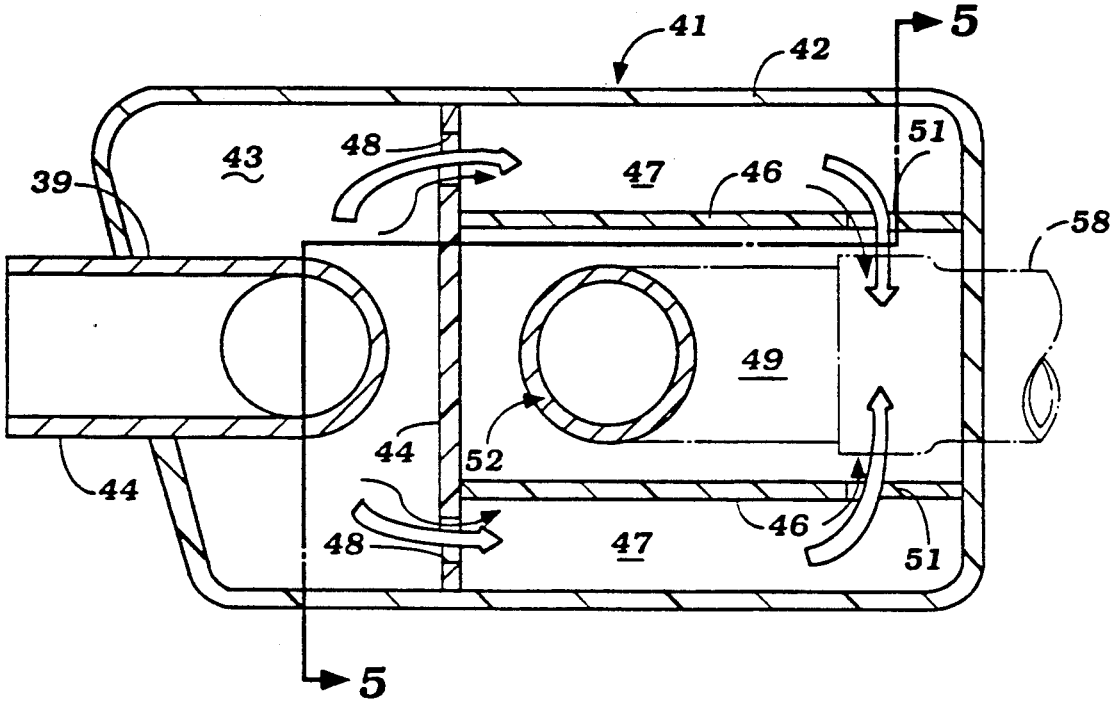
FIG. 4 is a cross-sectional view taken along the line 4—4 of FIG. 3.
Figure 5:
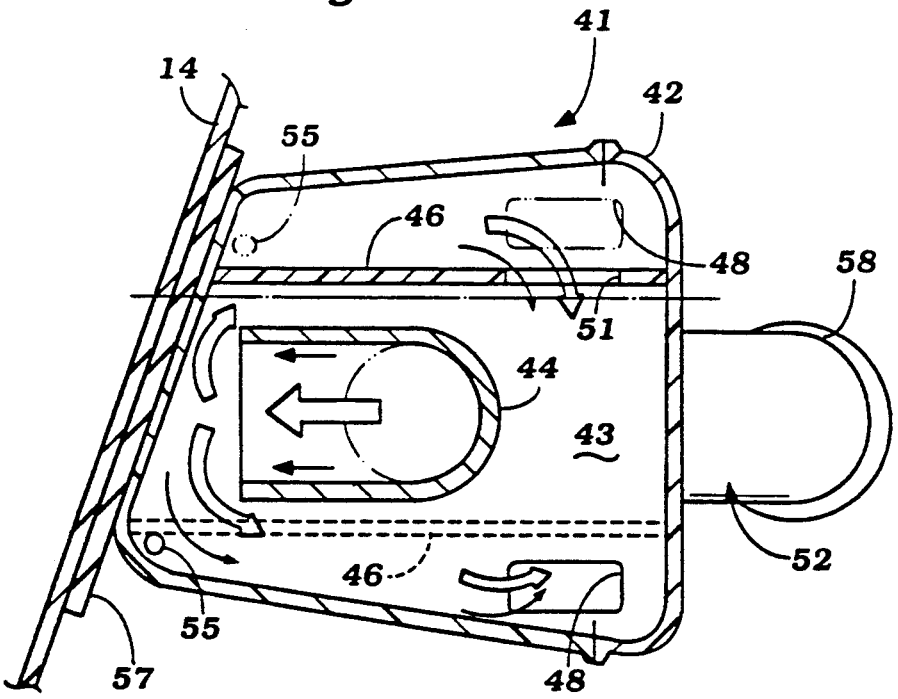
FIG. 5 is a cross-sectional view taken along the line 5—5 of FIG. 4.

Turning now to the exhaust system and referring additionally to FIGS. 3-5, the exhaust system includes an exhaust manifold 29 that receives the exhaust gases from the engine and delivers them through an exhaust pipe 31 to a first expansion chamber device, indicated generally by the reference numeral 32. The exhaust pipe 31 and first expansion chamber 32 maybe of the general type described in copending application Ser. No. 412,850, filed Sept. 26, 1989, entitled EXHAUST COOLING DEVICE FOR SMALL-SIZED BOAT, filed in the name of Ryoichi Nakase and assigned to the assignee of this application. That disclosure is incorporated herein by reference and, for that reason, a further description of this device is believed to be unnecessary. However, the device 32 includes an internal 34 and an outer wall member 35. The wall members 34 and 35 define between them a cooling jacket 36. The cooling jacket 36 receives coolant which has been delivered to a cooling jacket of the exhaust manifold 31 by the conduit 28.

The outer housing 35 has an outlet nipple 37 which communicates with a flexible conduit 38. It should be noted that the coolant from the cooling jacket 36 also will be discharged through this nozzle 37 to the conduit 38. The conduit 38 is, in turn, coupled to an inlet fitting 39 of a second expansion chamber device, indicated generally by the reference numeral 41 and constructed in accordance with a first embodiment of the invention.

Referring now in detail to FIGS. 3 through 5, the expansion device 41 is comprised of an outer housing 42 that has a generally box like configuration and which maybe formed from a suitable material such as a fiberglass reinforced resin or the like. The interior of the housing 42 is divided into a first expansion chamber 43 by a generally vertically extending wall 44. The inlet fitting 39 is formed by a generally L-shape pipe 44 that delivers exhaust gases in a downward direction into this first expansion chamber 43. The L-shape pipe 44 has a discharge end 45 that is disposed above the lower surface of the expansion chamber 43.

A pair of perpendicularly extending walls 46 extend from the wall 44 away from the expansion chamber 43 and terminate at the opposite end of the housing 42. The walls 4 thus define a pair of second expansion chambers 47. A pair of rectangular cutouts 48 formed in the upper end of the wall 44 permit the exhaust gases to flow from the expansion chamber 43 into the parallel expansion chambers 47. Hence, the exhaust gases will be silenced first by the expansion into the expansion chamber 43 and again by the contraction through the passages 48 and further expansion into the expansion chambers 47.

A third expansion chamber 49 is formed between the pair of expansion chambers 47 by the walls 46. A pair of rectangular shape openings 51 are provided at the upper ends of the walls 46 adjacent the outer housing 42 so that the exhaust gases will flow into the expansion chamber 49 in confronting relationship as shown in FIG. 4. Hence, this action will achieve silencing of the gases in addition to the silencing that is obtained by the contraction of the exhaust gases as they flow through the openings 51 and subsequently expand into the expansion chamber 49.

An L-shaped discharge pipe 52 extends through the top of the housing 42 and into the third expansion chamber 49. The pipe 52 has a lower end 53 that depends to the lower portion of the expansion chamber 49 and a discharge end 54 that is external of the expansion device 41.

It has been noted previously that the exhaust gases that are delivered to the expansion device 41 also contain cooling water from the engine. As may be seen in FIG. 3, this water will collect in the bottom of each of the expansion chambers. The water level will be higher in the expansion chamber 49 then the first expansion chamber 43 due to the higher exhaust gas pressure in this first expansion chamber. The water level will reach the inlet end 53 of the pipe 52 and then be forced out of the remainder of the exhaust system, to be hereinafter described. However, under low speed conditions there is a possibility that water could be forced through the openings 48 and 51 through the various expansion chambers. In addition, the variations in exhaust gas pressure could cause variations in the water level in the various expansion chambers 43, 47, and 49 and this would change their silencing effects. To avoid this, there are provided small weep holes 55 at the lower end of the wall 44 so that water may flow from the expansion chamber 43 to the expansion chambers 47. In a like manner, the walls 46 are provided with small weep holes 56 (FIG. 3) so as to permit water to flow from the pair of second expansion chambers 47 to the third expansion chamber 49.

The expansion device 41 is mounted on the hull 14 of the watercraft via an elastic pad 57 so as to reduce noise and vibration.

The discharge pipe 52 and specifically its discharge end 54 is connected to one end of a flexible conduit 58 that extends transversely across the side of the watercraft and then mates with a longitudinally extending pipe 59 having a discharge end 61 through the rear of the transom. As may be best seen in FIG. 3, the outlet 54 from the expansion device 41 is a substantial height $H_2$ above the most deeply submerged water level B of the watercraft, this being the level when the watercraft is at rest or operating at low speeds. The line A indicates the water level at planing. It should be noted that the exhaust pipe discharge 61 is also above the water level by either water level A or B and above the water level B by a height H so as to ensure that water cannot flow back into the exhaust system through the opening 61. Also, any water which may splash into the opening 61 cannot re-enter the expansion device 41 since there is a long run and uphill run to the outlet opening 54.

In the drawings the open arrows indicate the flow of exhaust gases through the system and the solid arrows indicate the flow of water from the cooling system of the engine through the exhaust system.

Figure 6:
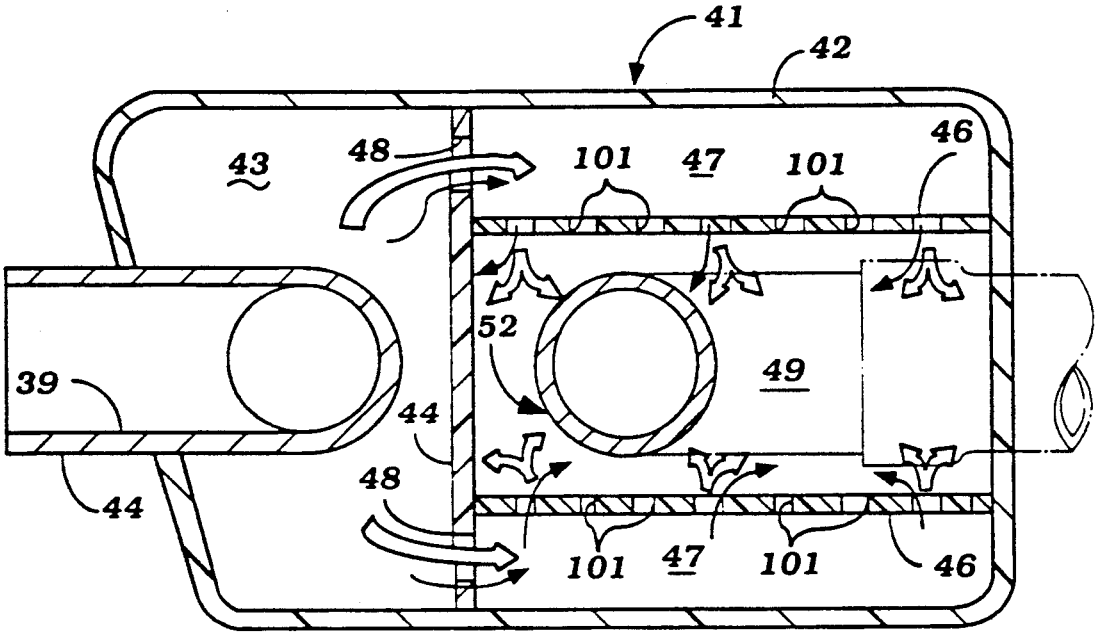
FIG. 6 is a cross-sectional view, in part similar to FIG. 4, and shows a further embodiment of the invention.

FIG. 6 shows another embodiment of the invention which is generally the same as the embodiment of FIGS. 1 through 5 and for that reason components which are the same have described again. However, in this embodiment, rather than the plurality of smaller confronting openings, indicated generally by the reference numerals 101. These smaller openings will divide the water flow through the expansion chamber 41 into a fine spray that will further assist in the silencing operation.

Figure 7:
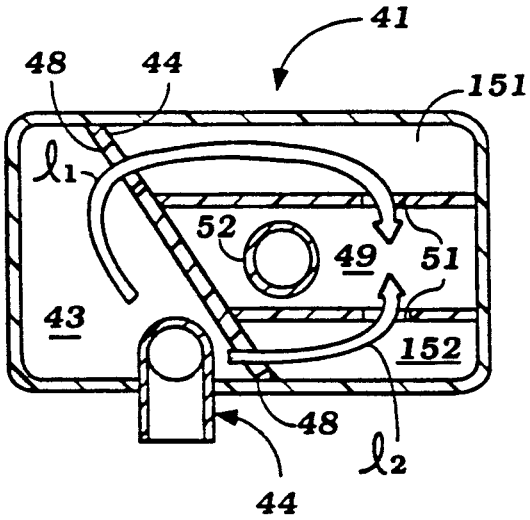
FIG. 7 is a reduced cross-sectional view, in part similar to FIGS. 4 and 6, and shows a third embodiment of the invention.

In the embodiments of the invention as thus far described, the expansion chambers 47 have been of the same volume and the flow length to them from the expansion chamber 43 was the same. FIG. 7 shows another embodiment of the invention wherein these expansion chambers are formed as having different effective volumes and different flow lengths to them.

This alternate construction permits each of these expansion chambers to be tuned slightly differently so that to further extend the range of silencing provided for by the device. However, the general construction of this embodiment is the same as those previously described and for that reason, components which are the same have been identified by the same reference numerals. In this embodiment the wall 44 is disposed at an angle as shown in FIG. 7 so that one of the pairs of expansion chambers 151 has a substantially larger volume than the other expansion chamber of this pair, which is indicated by the reference numeral 152. In addition, the flow path from the ports or openings 48 to the openings 51 have different lengths indicated by the lengths $l_1$ and $l_2$. Hence, slightly different tuning effects will be achieved. Also, this embodiment shows the exhaust inlet pipe 44 being disposed at the side of the expansion chamber 43 rather than at the end. With such an arrangement, the expansion device 41 may be positioned on the side of the engine 18 rather than in front of it as in the previously described embodiment. Of course, the pipe 44 may enter through one end of the expansion chamber for a forward placement as would the previously described embodiments.

It should be readily apparent from the foregoing description that a very effective expansion unit is provided for silencing the exhaust gases of a marine propulsion unit and will provide a good silencing through a plurality of expansions and contractions. Of course, the described embodiments are preferred embodiments of the invention and various changes and modifications may be made without departing from the spirit and scope of the invention, as defined by the appended claims.

We claim:

1. An exhaust silencer for exhaust gases of an internal combustion engine comprising a common housing defining a first expansion chamber, an exhaust inlet for delivering exhaust gases from said engine into said first expansion chamber, a pair of spaced apart second expansion chambers, restricted flow means for communicating said first expansion chamber directly with each of said pair of second expansion chambers for successive expansion contraction and expansion of the exhaust gases flowing therebetween, a third expansion chamber, restricted flow means communicating each of said second expansion chambers directly with said third expansion chamber for successive expansion contraction and expansion of the exhaust gases flowing therebetween, and means for discharging exhaust gases from said third expansion chamber to the atmosphere, said pair of second expansion chambers being disposed on and extending along opposite sides of said third expansion chamber.

2. An exhaust silencer as set forth in claim 1 wherein the first expansion chamber is disposed adjacent one side of the pair of second expansion chambers and the third expansion chamber.

3. An exhaust silencer as set forth in claim 2 wherein the restricted flow means for communicating the first expansion chamber with the pair of second expansion chambers comprise a pair of apertures formed in a wall separating the first expansion chamber from the second expansion chambers at the upper end thereof.

4. An exhaust silencer as set forth in claim 3 wherein the restricted flow means for communicating each of the second expansion chambers with the third expansion chamber comprises a pair of openings formed in the upper end of walls separating each of the second expansion chambers from the third expansion chamber.

5. An exhaust silencer as set forth in claim 4 wherein the openings are in facing relationship.

6. An exhaust silencer as set forth in claim 5 wherein water is delivered along with the exhaust gases to the exhaust silencer and wherein the walls are formed with small weep holes at the lower ends thereof for communicating the expansion chambers with each other and permitting water to flow therebetween to maintain substantially constant volume for the respective expansion chambers.

7. An exhaust silencer for exhaust gases of an internal combustion engine comprising a first expansion chamber, an exhaust inlet for delivering exhaust gases from said engine into said first expansion chamber, a pair of spaced apart second expansion chambers, means for communicating said first expansion chamber directly with each of said pair of second expansion chambers, a third expansion chamber disposed between said pair of second expansion chambers, means communicating each of said second expansion chambers directly with said third expansion chamber, and means for discharging exhaust gases from said third expansion chamber to the atmosphere, said expansion chambers all being formed in a common housing with the first expansion chamber disposed adjacent one side of said pair of second expansion chambers and said third expansion chamber, said means for communicating said first expansion chamber with said pair of second expansion chambers comprise a pair of apertures formed in a wall separating the first expansion chamber from the second expansion chambers at the upper end thereof.

8. An exhaust silencer as set forth in claim 7 wherein the means for communicating each of the second expansion chambers with the third expansion chamber comprises a pair of openings formed in the upper end of walls separating each of the second expansion chambers from the third expansion chamber.

9. An exhaust silencer as set forth in claim 8 wherein the openings are in facing relationship.

10. An exhaust silencer as set forth in claim 9 wherein water is delivered along with the exhaust bases to the exhaust silencer and wherein the walls are formed with small weep holes at the lower ends thereof for communicating the expansion chambers with each other and permitting water to flow therebetween to maintain substantially constant volume for the respective expansion chambers.

11. An exhaust silencer for support as a unit within a hull of a watercraft for silencing exhaust gases of a separate internal combustion engine supported within the hull at a location spaced from said exhaust silencer comprising a first expansion chamber, an exhaust inlet for delivering exhaust gases into said first expansion chamber, flexible conduit means for delivering exhaust gases from said inlet across said hull to said exhaust inlet, a pair of spaced apart second expansion chambers, means for communicating said first expansion chamber directly with each of said pair of second expansion chambers, a third expansion chamber, means communicating each of said second expansion chambers directly with said third expansion chamber, said expansion chambers all being formed in a common housing, and conduit means for discharging exhaust gases from said third expansion chamber to the atmosphere through the hull of said watercraft.

12. An exhaust silencer as set forth in claim 11 wherein the pair of second expansion chambers are disposed on opposite sides of the third expansion chamber.

13. An exhaust silencer as set forth in claim 12 wherein the first expansion chamber is disposed adjacent one side of the pair of second expansion chambers and the third expansion chamber.

14. An exhaust silencer as set forth in claim 13 wherein the means for communicating the first expansion chamber with the pair of second expansion chambers comprises a pair of apertures formed in wall separating the first expansion chamber from the second expansion chambers at the upper end thereof.

15. An exhaust silencer as set forth in claim 14 wherein the means for communicating each of the second expansion chambers with the third expansion chamber comprises a pair of openings formed in the upper end of walls separating each of the second expansion chambers form the third expansion chamber.

16. An exhaust silencer as set forth in claim 15 wherein the openings are in facing relationship.

17. An exhaust silencer as set forth in claim 16 wherein water is delivered along with the exhaust gases to the exhaust silencer and wherein the walls are formed with small weep holes at the lower ends thereof for communicating the expansion chambers with each other and permitting water to flow therebetween to maintain substantially constant volume for the respective expansion chambers.

18. An exhaust silencer as set forth in claim 11 wherein the pair of second expansion chambers are disposed on opposite sides of the third expansion chamber.

19. An exhaust silencer as set forth in claim 18 wherein the first expansion chamber is disposed adjacent one side of the pair of second expansion chambers and the third expansion chamber.

20. An exhaust silencer as set forth in claim 11 wherein the means communicating the second pair of expansion chambers with the third expansion chamber comprise facing openings wherein the flow of exhaust gases from the second expansion chambers to the third expansion chamber is confronting relationship.

21. An exhaust silencer as set forth in claim 11 wherein the second expansion chambers have different effective volumes.

22. An exhaust silencer as set forth in claim 21 wherein the length of the flow from the first expansion chamber through one of the second expansion chambers to the third expansion chamber is longer than the flow from the first expansion chamber through the other of the second expansion chambers to the third expansion chamber.

23. An exhaust silencer as set forth in claim 11 wherein water is delivered to the exhaust silencer along with the exhaust gases and wherein means for communicating at least one of the expansion chambers with another of the expansion chambers comprises a number of relatively small orifices through which the water will be atomized as it flows therethrough with the exhaust gases for improving the water exhaust gas contact.

* * * * *